United States Patent [19]

Schaad et al.

[11] Patent Number: 4,513,187

[45] Date of Patent: Apr. 23, 1985

[54] HIGH-VOLTAGE CIRCUIT BREAKER INCLUDING CUT-ON RESISTOR

[75] Inventors: Walter Schaad, Oberentfelden; Peter Kull, Schafisheim, both of Switzerland

[73] Assignee: Sprecher & Schuh AG, Aarau, Switzerland

[21] Appl. No.: 560,575

[22] Filed: Dec. 12, 1983

[30] Foreign Application Priority Data

Dec. 17, 1982 [CH] Switzerland ..... 7367/82

[51] Int. Cl.[3] ..... H01N 33/16

[52] U.S. Cl. ..... 200/144 AP; 200/146 R; 200/148 D; 200/148 F

[58] Field of Search ..... 200/144 AP, 146 R, 148 D, 200/148 F

[56] References Cited

U.S. PATENT DOCUMENTS

| | | | |
|---|---|---|---|
| 3,676,621 | 7/1972 | Pflanz | 200/146 R |
| 4,433,220 | 2/1984 | Buhler et al. | 200/144 AP |
| 4,443,674 | 4/1984 | Calvino | 200/144 AP |

*Primary Examiner*—Robert S. Macon

*Attorney, Agent, or Firm*—Werner W. Kleeman

[57] ABSTRACT

A series connection of an auxiliary switching position and a cut-on resistor is connected parallel to at least one primary switching position. A common drive rod is provided with which there is coupled a transmission system operatively associated with the primary switching position as well as a transmission system operatively associated with the auxiliary switching position. The transmission system associated with the auxiliary switching position comprises a cam cooperating with a follower or entrainment member mounted to an actuator rod leading to the auxiliary switching position. For positively controlling the sequence of movements without having to tension a spring during the cut-on of the auxiliary switching position the cam comprises a stationary cam or guide track containing a closed loop engaged by the follower member. Additionally, the follower member traverses an elongated hole of a bracket or cantilever connected with a longitudinally reciprocatable drive rod and extending parallel to the plane of the cam or guide track. The elongated hole extends transversely with respect to the direction of movement of the drive rod at least across the width of the closed loop. The follower member is guided through the closed loop in only one revolving direction of travel.

12 Claims, 9 Drawing Figures

HIGH-VOLTAGE CIRCUIT BREAKER INCLUDING CUT-ON RESISTOR

CROSS-REFERENCE TO RELATED APPLICATION

This application is related to the commonly assigned, copending U.S. application Ser. No. 358,217, filed Mar. 15, 1982, entitled "High Voltage Circuit Breaker".

BACKGROUND OF THE INVENTION

The present invention relates to a new and improved high-voltage circuit breaker or switch.

The present invention relates specifically to a new and improved high-voltage circuit breaker comprising at least one primary switching position and an auxiliary switching position series connected with a cut-on resistor and connected in parallel to the primary switching position. A common drive rod is operatively coupled to both a first linkage transmission system leading to the primary switching position and to a second linkage transmission system comprising an actuator rod controlled at one end thereof by a follower or entrainment member cooperating with a cam and leading to the auxiliary switching position. Means are provided which during a cut-on stroke sequentially cause closing of the auxiliary switching position, then closing of the primary switching position and thereafter opening of the auxiliary switching position.

In a high-voltage circuit breaker as known, for example, from German Patent Publication No. 1,939,555, published Feb. 12, 1980, the cam has the shape of a segment-shaped cam disc which is rigidly non-rotatably mounted to a drive rod which is rotated in one rotational direction for the cut-on stroke and in the other rotational direction for the cut-off stroke. A follower member coupled to a movable switching member rolls upon the circumference of the cam disc. During a cut-on stroke the cam disc displaces the aforementioned switching member against the action of a spring into its cut-on position, retains the same in this position until immediately prior to the actual completion of the cut-on stroke of the circuit breaker and thereafter releases the follower member. The switching member of the auxiliary switching position then jumps back into its original position under the action of the spring which has been tensioned by the cut-on stroke.

It is a disadvantage inherent in this operational and functional concept that at the end of the jump-back of the switching member at the auxiliary switching position two stops impact against one another and the blow originating therefrom may with time be detrimental for different parts of the system, namely the movable members of the auxiliary switching position, not even taking into account wear. Additionally, the spring associated with the switching member at the auxiliary switching position must be tensioned during each cut-on stroke and the work required therefor must be exerted by the drive unit of the circuit breaker. Finally, it should be mentioned that it is in particular the contact breaking stroke occurring at the auxiliary switching position at the end of the cut-on stroke which is exclusively dependent upon the faultless functioning of the spring as well as upon the trouble-free displaceability of the switching member associated with the auxiliary switching position. In case that, for example, due to some deposits or contaminants the switching member sticks in the cut-on position or the spring breaks then the aforementioned functions are no longer ensured, i.e., the contact breaking stroke at the auxiliary switching position is not guaranteed to occur because this action neither is visible nor controllable from the outside.

Similar conditions prevail in a high-voltage circuit breaker as known, for example, from European Patent Publication No. 0,031,791, published July 8, 1981. Here the switching member at the auxiliary switching position is coupled by a connecting rod to a kind of crank drive. This crank drive comprises a disc which is mounted for rotation with a drive rod but is non-rotatable with respect thereto. The drive rod is rotatable or rockable back-and-forth through an angle of about 90°, and in the disc there is formed a circularly-shaped or arcuate cam track extending over an angle of about 90° and arranged concentrically with respect to the drive rod. The cam track comprises a radially outwardly bent-off section at one of its ends and a rubber cushion or shock absorber at the other one of its ends. In the cut-off position the connecting rod extends over the drive rod and engages the bent-off section of the cam track by means of a follower or entrainment member placed at the end of the connecting rod located on the side of the drive. The switching member at the auxiliary switching position is biased into the cut-off position by means of a spring. Now when the cam track is rotated by the drive rod in a direction in which the bent-off section leads the cam track, then the switching member at the auxiliary switching position is advanced by the connecting rod and against the action of the spring into the contact-making or closed position, until the bent-off section of the cam track has arrived at such a position relative to the displacement direction of the switching member that the spring thereof can urge the follower member at the connecting rod out of the bent-off section. Thereafter the follower or entrainment member is abruptly displaced through the cam track under the action of the spring until abutting the rubber cushion at the other end. Simultaneously, the switching member at the auxiliary switching position performs the contact-breaking or opening stroke.

The observations previously made with reference to German Patent Publication No. 1,939,555 are here valid even to a greater extent. The contact-breaking or opening stroke at the auxiliary switching position only is ensured if the spring functions in a trouble-free manner, if the switching member is displaceable, and additionally if the follower member is freely displaceable in the cam track. Also in this case a spring must be tensioned during the cut-on stroke and, here too, the jump-back of the switching member at the auxiliary switching position generates shocks which are, however, somewhat attenuated by the rubber cushion or shock absorber.

SUMMARY OF THE INVENTION

Therefore, with the foregoing in mind it is a primary object of the present invention to provide a new and improved high-voltage circuit breaker in which the movements of the switching member at the auxiliary switching position are positively controlled also during the cut-off stroke.

Another important object of the present invention is directed to the provision of a new and improved high-voltage circuit breaker in which no spring need be tensioned during the cut-on stroke of the switching member at the auxiliary switching position.

Still another significant object of the present invention is directed to the provision of a new and improved high-voltage circuit breaker in which the entire sequence of movements is performed free of any impacts or shocks.

Now in order to implement these and still further objects of the invention, which will become more readily apparent as the description proceeds, the high-voltage circuit breaker of the present development is manifested by the features that, the cam is formed by a stationary arranged cam or guide track containing a closed or endless planar loop in the plane of movement of the actuator rod. In such cam or guide track there engages the follower or entrainment member present at the end of the actuator rod. This follower or entrainment member additionally traverses or piercingly extends through an elongated hole or slot in a bracket or cantilever member extending parallel to the plane of the cam or guide track and secured to a drive rod reciprocatingly displaceable in longitudinal direction. The elongated hole extends transversely relative to the direction of movement of the drive rod and at least across the width of the loop. Also there are provided means for guiding the follower or entrainment member through the closed loop in only one revolving direction of travel.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
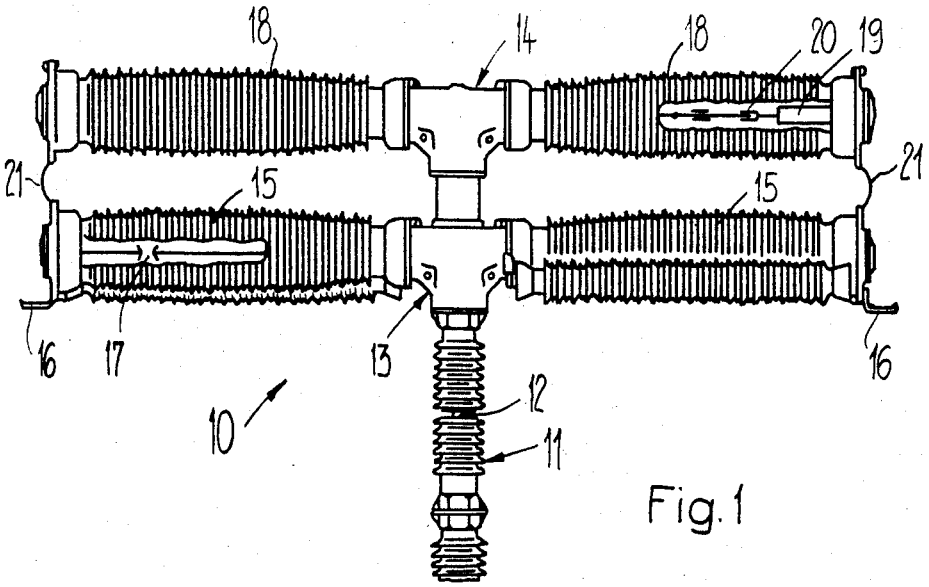
FIG. 1 is a simplified external view of a high-voltage circuit breaker according to the present invention constructed in a "T"-mode and including two series connected primary switching positions to each of which an auxiliary switching position including a cut-on resistor is parallel connected.

Describing now the drawings, it is to be understood that only enough of the construction of the high-voltage circuit breaker or switch has been shown as needed for those skilled in the art to readily understand the underlying principles and concepts of the present development, while simplifying the showing of the drawings. Turning attention now specifically to FIG. 1, there has been schematically illustrated a high-voltage circuit breaker 10 in a "T"-mode of construction the voltage-carrying or live parts of which are supported at a substantially tube-shaped support insulator 11. A drive rod 12 is arranged within the interior of the support insulator 11. This drive rod 12 extends from any suitable drive unit (not shown) for the high-voltage circuit breaker and can be longitudinally reciprocated by such drive unit or drive. A metallic transmission system housing 13 and, thereon, a further transmission system housing 14 is supported at the support insulator 11. As will be shown further below the drive rod 12 extends into both of the transmission system housings 13 and 14. Two substantially tube-shaped insulators 15 extend from the transmission system housing 13, each of which includes a conventional primary switching position or location 17 only schematically indicated on the left in FIG. 1 and designed, for example, in the manner of a conventional gas-blast switch. High-voltage conductors 16 are connected to the primary switching positions 17, which can either be interconnected via the primary switching positions 17 or which can be separated from each other even under load.

Two substantially tube-shaped insulators 18 also extend from the transmission system housing 14 and each include, as schematically shown on the right, a series connection or circuit of a cut-on resistor 19 and an auxiliary switching position or location 20. The electrical parts within the insulators 18 are connected via conductors 21, on the one hand, and via the transmission system housings 13, 14, on the other hand, parallel to the associated primary switching positions 17.

The auxiliary switching positions or locations 20 as well as the primary switching positions or locations 17 each are driven from the drive rod 12 via a respective transmission system or means. These transmission systems will now be described in greater detail with reference to FIGS. 2 and 3.

Figure 2:
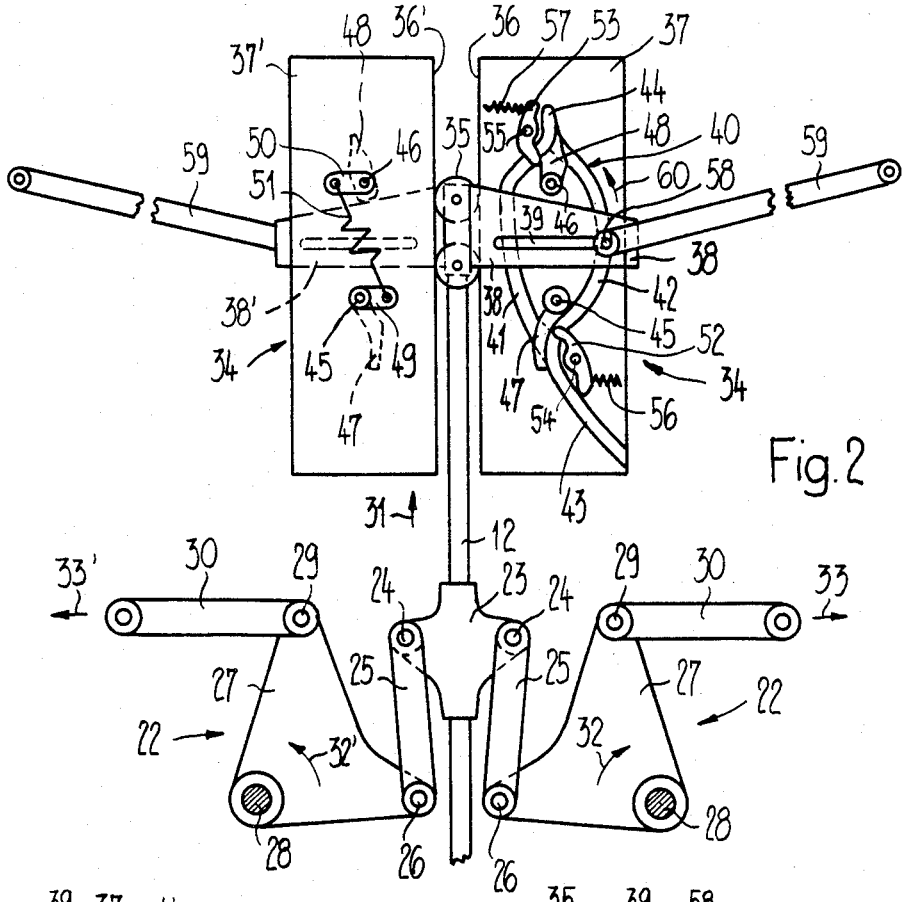
FIG. 2 is a simplified view of the transmission systems or means operatively associated with the primary and auxiliary switching positions in the high-voltage circuit breaker shown in FIG. 1, the right-hand half of the figure showing a second embodiment of the inventive high-voltage circuit breaker.

There will be recognised in FIG. 2 the drive rod 12 in a position which it assumes during the course of a cut-on stroke. The transmission system or means associated with the primary switching positions 17 and arranged within the transmission system housing 13 are purely lever or linkage transmissions or drives, each of which is conveniently designated by reference character 22. A coupling member 23 is operatively secured to the drive rod 12 and is provided with bearing eyelets; on each of the two sides thereof one end of a respective connecting rod or coupling link 25 is linked to the coupling member 23. The other ends of the connecting rods or coupling links 25 are each linked or pivoted at 26 to one arm of a respective bell crank lever 27 which, in turn, is pivotable about a related stationary pivot pin 28 or the like. To another arm of each bell crank lever 27 and specifically at hinge location 29 there is linked a respective connecting rod or coupling link 30, each of which as such is linked or hingedly connected to a respective actuator rod (not shown) which extends to the related primary switching position 17. As will be apparent from the foregoing description, during the cut-on stroke of the drive rod 12, see the arrow 31, the bell crank levers 27 are pivoted in the direction of the arrows 32 and 32' in order to convert such movement into a displacement indicated by the arrows 33 and 33' without reversal of the movement. In other words, the first linkage transmissions or transmission systems 22 merely redirect the movement of the drive rod 12, and specifically, with a transmission ratio which depends upon the ratio of the length of the arms of the bell crank or angle levers 27.

This is however not so for the transmission systems or means 34 operatively associated with the auxiliary switching positions 20 which constitute second linkage transmissions to be described hereinbelow primarily with reference to FIGS. 2 and 3. The drive rod 12 supports at its upper end two rollers 35 by means of which the drive rod 12 is rectilinearly guided between the confronting parallel longitudinal edges or sides 36 and 36' of two plates 37 and 37', respectively, which are stationarily arranged in the transmission system housing 14, as best seen by referring to FIG. 3.

At the level of the rollers or rolls 35 two brackets or cantilever members 38 and 38' are mounted to the drive rod 12. The bracket 38 spans the related plate or plate member 37 on the side facing the viewer and the other bracket 38' spans its related plate or plate member 37' on the side remote from the viewer of the drawings of FIGS. 2 and 3. Rectilinear continuous elongated holes or slots 39 and 39' are each formed in the related bracket or cantilever member 38 and 38', respectively, and extend orthogonally with respect to the drive rod 12. On the side facing the respective brackets 38 and 38' a cam or guide track 40 is formed in each plate 37 and 37'. In FIGS. 2 and 3 only the cam or guide track 40 in the plate 37 is visible, since the cam or guide track in the other plate 37' is remote from the viewer.

Figure 3:
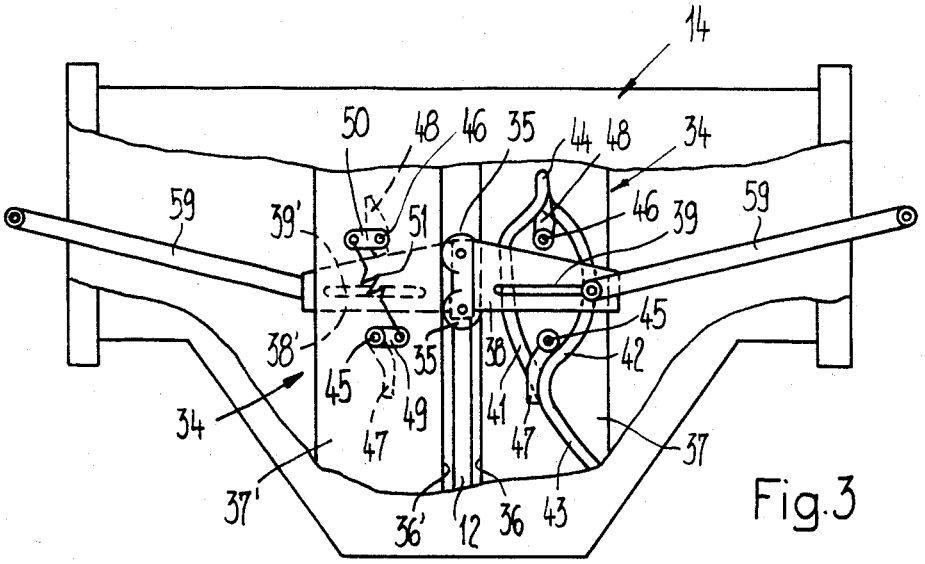
FIG. 3 is a view of the transmission system or means operatively associated with the auxiliary switching positions shown in FIG. 1 and in their arrangement in an appropriate transmission system housing.

It will be clearly seen from FIGS. 2 and 3 that the cam or guide track 40 describes a self-contained or closed loop. This closed or endless loop comprises a section or portion 41 which convexly extends with respect to the drive rod 12 and a section or portion 42 which concavely extends with respect to such drive rod 12. Both of these cam sections 41 and 42 each open at both ends into a respective common end section or portion 43 and 44. In the region of the two end sections 43 and 44 there are arranged deflector tongues 47 and 48, respectively, which are resiliently biased into a rest position and which are seated on pivot pins 45 and 46, respectively, and which can be passed in only one direction.

These deflector or switching tongues 47, 48 can be biased in different ways. For example, as shown at the top on the left-hand side of FIG. 2, the pivot pins 45 and 46 of the deflector tongues 47 and 48, respectively, may traverse the corresponding plate 37 and 37', respectively, and they may each carry at that location a protruding lever 49 and 50, respectively, the free ends of which may be interconnected by a tension spring 51. In the second embodiment of the inventive high-voltage circuit breaker, which is shown on the right-hand side of FIG. 2, the deflector tongue 47 as well as the deflector tongue 48 are each associated with a respective two-armed or double-arm lever 52 and 53 which is pivotable about a respective pivot pin 54 and 55 seated in the related plate 37. These double-arm levers 52 and 53 urge with one of their ends the associated deflector tongue 47 or 48 into a rest position as shown, since they are exposed at their other end to the action of a respective tension spring 56 and 57.

Now when the deflector tongues 47 and 48 are displaced from their rest positions the double-arm levers 52 and 53, respectively, are also pivoted and the other ends thereof will then cover the cam or track section 43 and 44, respectively, of the cam or guide track 40. As soon as an entrainment or follower member 58 guided by the cam or guide track 40, after passing the deflector tongue 47 or 48, advances into one of the cam sections 43 or 44, as will still be explained hereinafter, it will then displace at that location the other ends of the levers 52 and 53, respectively, which, in turn, will force the deflector tongues 47 and 48, respectively back again into their respective rest positions.

The entrainment or follower members 58, as already mentioned hereinbefore, also traverse or extend through their related elongated hole 39 or 39' in the brackets 38 and 38', respectively, and are mounted at the end of respective actuator rods 59 extending towards the related auxiliary switching positions 20.

It will be apparent from the foregoing discussion that during the switching strokes the entrainment or follower member 58 can only travel in a counter-clockwise direction (arrow 60) through the closed loop of the cam or guide track 40 which appears on the right in FIGS. 2 and 3. While only just slightly more than half of the cut-on stroke has been covered in the position as shown in FIGS. 2 and 3, the entrainment or follower member 58 is located at its most distant position from the drive rod 12, i.e. contact will already be made at the auxiliary switching position 20 which is thus closed. Shortly thereafter the switching members or elements of the primary switching positions 17 which are displaced via the connecting rods or coupling link 30 will engage each other while the contact elements at the auxiliary switching positions 20 connected to the actuator rod 59 already will start their cut-off stroke.

Figure 4:
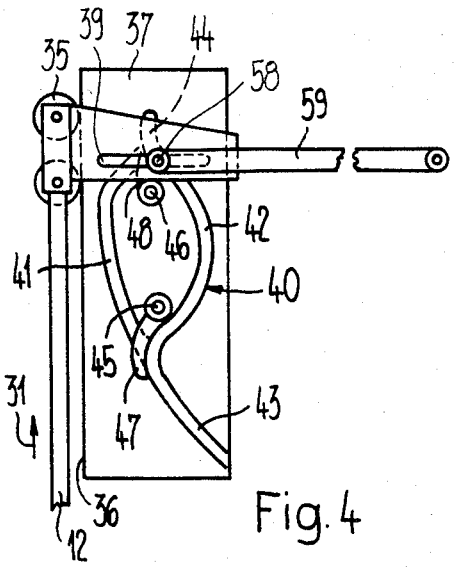
FIG. 4 shows a detail of the right-hand half of the transmission system or means shown in FIG. 2 shortly prior to the end of a cut-on stroke of the high-voltage circuit breaker shown in FIGS. 1 and 2.

A position assumed close to the end of the cut-on stroke in the high-voltage circuit breaker 10 is shown in FIG. 4. Contact has already been made at the primary switching positions 17. The entrainment or follower member 58 which is guided by the elongated hole or slot 39, on the one hand, and by the section 42 of the cam or guide track 40, on the other hand, has now been again moved closer to the drive rod 12 and the contact at the auxiliary switching positions 20 is now broken. The deflector tongue 48 has been displaced by the entrainment or follower member 58 from its rest position and this follower member is now about to enter the end or terminal section 44.

Figure 5:
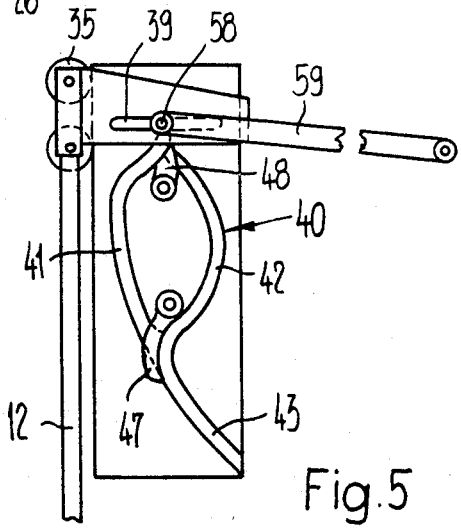
FIG. 5 shows the detail illustrated in FIG. 4 at the end of the cut-on stroke.

In FIG. 5 the position assumed at the end of the cut-on stroke is illustrated. The actuator rod 59 has still been somewhat farther withdrawn or retracted as compared to FIG. 4 by the action of the entrainment or follower member 58 which now has entered the end section 44.

Figure 6:
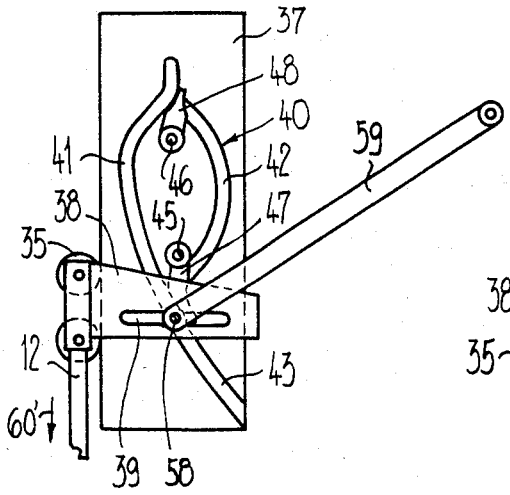
FIG. 6 shows the detail illustrated in FIG. 4 during the course of a cut-off stroke.

During the cut-off stroke the drive rod 12 is downwardly moved from the position indicated in FIG. 5, as indicated by the arrow 60' in FIG. 6. During such movement the entrainment or follower member 58 is entrained by the elongated hole or slot 39 and is forced to follow the cam or track section 41 of the cam or guide track 40 by virtue of the presence and position of the deflector tongue 48. The result is that the movable contact elements at the auxiliary switching positions 20 are still farther withdrawn while the movable contact elements at the primary switching positions 17 only start to be disengaged.

The contact elements of the primary switching positions 17 are spaced from each other at about the ideal extinguishing distance in the position of the cut-off stroke as shown in FIG. 6. In this position the entrainment or follower member 58 has already passed through the cam section 41, the actuator rod 59 has been withdrawn or retracted still farther and, additionally, the deflector tongue 47 has been displaced from its rest position by the entrainment or follower member 58 which is thus enabled to enter the end or terminal section 43.

Figure 7:
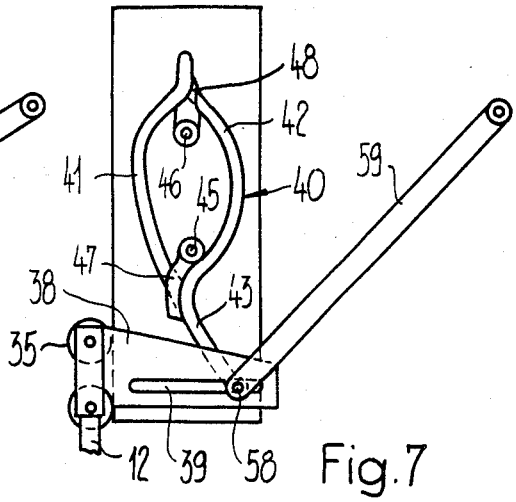
FIG. 7 shows the detail illustrated in FIG. 4 at the end of the cut-off stroke or, respectively, prior to the start of the next-following cut-on stroke.

The cut-off position is shown in FIG. 7. The drive rod 12 has now arrived at its lowermost position, the movable contact elements at the primary switching positions 17 are located at the greatest distant from the associated stationary contact elements, the switching arc has been extinguished and the entrainment or follower member 58 has been entrained so as to assume its terminal position in the end section 43, the actuator rod 59 still being somewhat farther withdrawn.

During a cut-on stroke starting from the position as shown in FIG. 7 the entrainment or follower member 58 is, then, forced by the deflector tongue 47 to again follow the cam or track section 42 of the cam or guide track 40.

Figure 8:
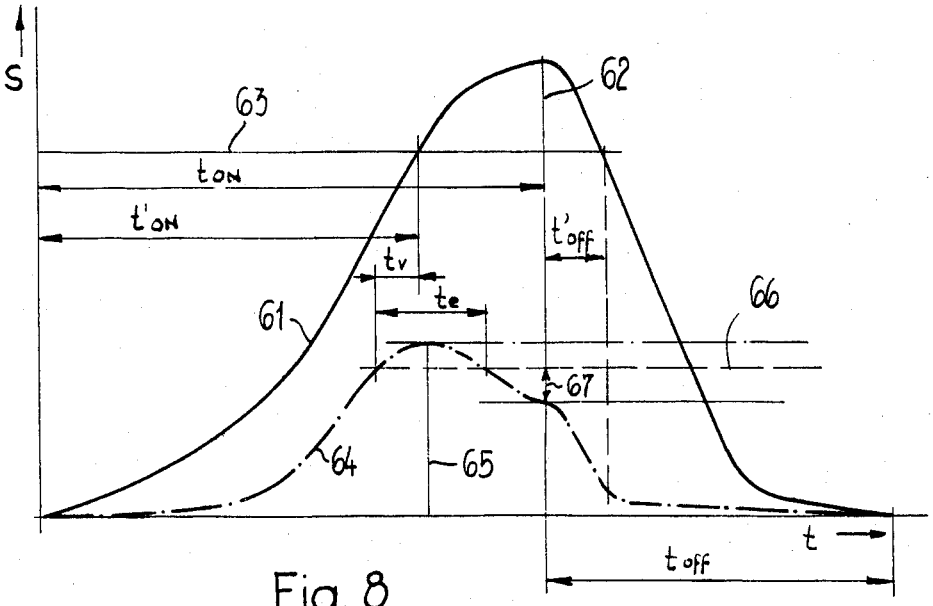
FIG. 8 is a distance-time (s-t) diagram depicting the course of the movements of the movable switching members at the primary switching position with a continuous or full line and at the auxiliary switching position with a dash-dotted line, on the left during a cut-on stroke and on the right during a subsequent cut-off stroke of the high-voltage circuit breaker according to the invention.

In FIG. 8 there is illustrated a distance-time diagram (s-t diagram) portraying the sequence of movements of the displaced movable contact elements at the primary switching positions 17 and at the auxiliary switching positions 20, respectively, and which are moved by the transmission system or means 22 and 24, respectively.

The continuous or full line curve 61 shows the course of movement of the movable contact elements at the primary switching positions 17, namely to their apex or zenith during the course of a cut-on stroke and from their apex or zenith during a cut-off stroke. The length of the line 62 corresponds to the total distance covered during a switching stroke. The height of the line 63 indicates that part of the entire switching stroke which must be covered until the contact elements of the primary switching positions 17 contact each other. The entire cut-on stroke lasts for the time $t_{on}$, however, the contact elements at the primary switching positions 17 are already engaged after the time $t'_{on}$. The entire cut-off stroke lasts for the time $t_{off}$, however, the contact elements are already disengaged after the time $t'_{off}$ as computated from the end of the cut-on stroke. The dash-dotted curve 64 indicates the course of movement of the movable contact elements at the auxiliary switching positions 20 which are displaced by the transmission system or means 34 during one entire switching cycle encompassing the cut-on and the cut-off stroke. The length of the line 65 corresonds to the distance or path of a total switching stroke of the movable contact elements at the auxiliary switching positions 20, while the height of the line 66 indicates that part of the aforementioned switching stroke which must be covered until the contact elements at the auxiliary switching positions 20 contact each other or, respectively, separate from each other.

It will be evident from FIG. 8 that the auxiliary switching positions 20 are cut on at a moment of time which is prior to the moment of time at which the contact elements at the primary switching positions 17 start to engage with one another, by a time period $t_v$. From this moment the auxiliary switching positions 20 will remain closed for a period of time $t_e$. The end of the time period $t'_{on}$, i.e. the moment of time at which the contact elements of the primary switching stations 17 start to engage, occurs within the time period $t_e$. The end of the time period $t_e$ still precedes the end of the time period $t_{on}$, i.e. precedes the end of the cut-on stroke of the high-voltage circuit breaker 10. Between the end of the time period $t_e$ and the end of the time period $t_{on}$ the movable contact elements of the auxiliary switching positions 17 have separated from each other by the distance 67.

During the cut-off stroke, i.e. during the time period $t_{off}$, the movable contact elements at the auxiliary switching positions 20 will, then, return into their original positions.

Figure 9:
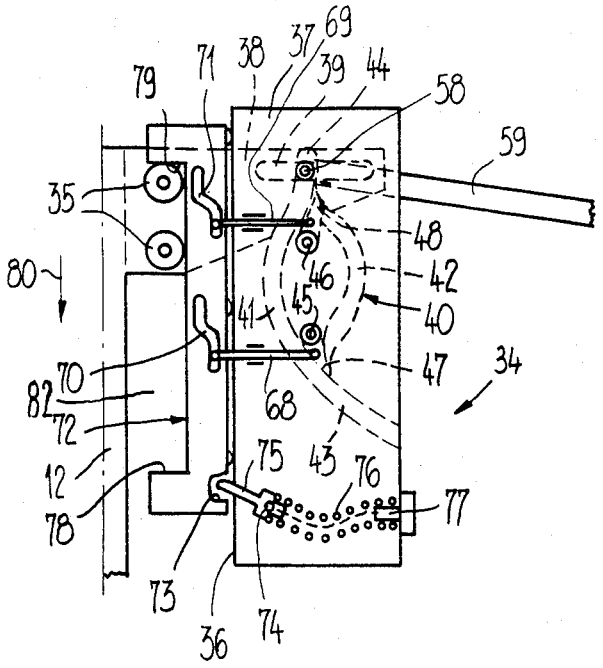
FIG. 9 is a schematic illustration of part of a third embodiment of the high-voltage circuit breaker according to the invention.

In FIG. 9 a third embodiment of the high-voltage circuit breaker according to the invention is shown; parts thereof which corresponds to identical parts depicted in the embodiments as described hereinbefore are designated by the same reference numerals. On the side of the plate 37 which is remote from the viewer of such drawing the bracket or cantilever 38 including the elongated hole or slot 39 will be recognised which is traversed or pierced by the entrainment or follower member 58 arranged at the actuator rod 59, and also there will be recognized the cam or guide track 40 in the plate 37. In this embodiment the deflector tongues 47 and 48 are not spring-biased into a rest position but are positively controlled.

For this purpose one end of a respective displaceably guided adjusting rod 68 and 69 is articulated to the related deflector or switching tongue 47 and 48, respectively, and the other end thereof engages a cam or guide track 70 and 71, respectively, each having an elongated or extended S configuration. The guide tracks 70 and 71 are formed in a slide or slide member 72 which is slidably guided at the lateral edge or face 36 of the plate 37 between two end or terminal positions. At its lower end this slide 72 contains a recess or cut-out 73 engaged by one end of a finger member 75 pivotably mounted to the plate 37 as indicated at pivot location or point 74. One end of a compression spring 76 is operatively engaged with the other end of the finger member 75, and the other end of such spring 76 engages with an abutment 77 mounted to the plate 37 approximately at the same level as the pivot mounting location 74. Since the compression spring 76 in its relaxed state is longer than the distance between the pivot mounting location 74 and the abutment or stop 77 and since it is furthermore not guided, the compression spring 76 will bend to one or the other side depending upon the position of the finger member 75.

Additionally, a guide or guiding track 82 limited by two stops or abutments 78 and 79 is formed at the slide or slide member 72 for the rollers or rolls 35 at the drive rod 12, the length of the guiding track 80 being smaller than the length of the switching stroke minus the distance between the two rollers 35.

In FIG. 9 the transmission system or means 34 are shown in the cut-on position of the high-voltage circuit breaker. The upper one of the rollers 35 engages the stop 79 and the entrainment or follower member 58 is located in the upper end section or portion 44 of the cam or guide track 40.

Now when a cut-off stroke occurs in the direction of the arrow 80, then the drive rod 12 and conjointly therewith the rollers 35 and the bracket or cantilever 38 will be downwardly moved. The deflector or switching tongues 48 and 47 are positioned such that the entrainment or follower member 58, coming from the end section or portion 44, passes through the convex section 41. At first the slide 72 will remain in the position as shown in FIG. 9 under the action of the spring 76. Shortly prior to the end of the cut-off stroke the lower one of the rollers 35 will abut the stop 78 and cause the slide 72 to also be downwardly moved. As a consequence, on the one hand, also the cam or guide tracks 70 and 71 will be downwardly moved relative to the respectively associated adjusting rods or coupling links 68 and 69 and, on the other hand, the finger member 75 is pivoted in counterclockwise direction. The spring 76 is thus forced to bend from the bent position as shown to the other side, whereby the finger member 75 tilts or rocks and now resiliently biases the slide 72 downwardly into the other end position thereof via the recess 73. In the meantime, the cam or guide tracks 70 and 71 have been downwardly displaced to such an extent that the adjusting rods 68 and 69 engage the end regions of the cam tracks 70 and 71 located more remote from the plate 37, whereby the deflector or switching tongues 47 and 48 will be positively switched.

During a subsequent cut-on stroke the deflector tongues 47 and 48 which have thus been switched direct the entrainment or follower member 58 coming from the end section 42 to the concave section 42. Only close to the end of the cut-on stroke will the upper one of the rollers 35 abut the stop 79, so that the slide 72 is upwardly displaced and the finger member 75 tilts back into the position as shown in FIG. 9. The deflector or switching tongues 47 and 48 also are thus returned into the position shown in FIG. 9. The embodiment of the high-voltage circuit breaker 10 as described hereinbefore has the advantage that there is excluded, so-to-speak, that the deflector or switching tongues 47, 48, whatever the reason, will become stuck in an intermediate position. On the other hand, what has been discussed with reference to FIG. 8 will also be true for the embodiment here described with reference to FIG. 9.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A high-voltage circuit breaker comprising:

at least one primary switching position;

at least one auxiliary switching position connected in parallel to said at least one primary switching position;

at least one cut-on resistor series connected to said at least one auxiliary switching position;

a common drive rod operatively associated with both said at least one primary switching position and said at least one auxiliary switching position and reciprocatingly movable in substantially longitudinal direction in a predetermined direction of movement;

a first transmission system coupled to said drive rod and operatively associated with said at least one primary switching position;

a second transmission system coupled to said drive rod and comprising an actuator rod and a cam;

a follower member cooperating with said cam;

said actuator rod being controlled at one end thereof by said follower member cooperating with said cam and being operatively associated with said at least one auxiliary switching position;

said actuator rod being movable in a predetermined plane of movement;

means for providing during a cut-on stroke a chronological operational sequence in which first said at least one auxiliary switching position is closed, then said at least one primary switching position is closed, and thereafter said at least one auxiliary switching position is opened;

said means comprising:

a stationarily arranged cam track defined by said cam and containing a closed loop extending in a plane and having a width;

said closed loop being substantially arranged in said plane of movement of said actuator rod;

said cam track being engaged by said follower member;

a bracket mounted to said drive rod and extending substantially parallel to said plane in which said cam track is arranged;

said bracket possessing an elongated hole traversed by said follower member and extending transversely relative to said predetermined direction of movement of said drive rod at least across said width of said closed loop; and means for guiding said follower member in only one revolving direction of movement through said closed loop.

2. The high-voltage circuit breaker as defined in claim 1, wherein:

said closed loop comprises:

a substantially convex section extending convexly with respect to said drive rod and a substantially concave section extending concavely with respect to said drive rod;

common end sections with which merge said convex and concave sections;

a respective deflector tongue cooperating with each said common end section; and said deflector tongues assuming respective rest positions in which an inlet to said convex section and to said concave section of said closed loop is freed.

3. The high-voltage circuit breaker as defined in claim 2, further including:

a spring provided for each deflector tongue; and said deflector tongues being displaceable from said convex and concave sections and from their respective rest positions against the force of their related spring.

4. The high-voltage circuit breaker as defined in claim 3, further including:

double-arm levers resiliently biased towards said deflector tongues for controlling the same; and each said double-arm lever having a free arm overlapping an adjacent one of said common end sections when its associated deflector tongue is deflected from said rest position thereof and being displaceable from said end section by said follower member when the same enters said end section so as to positively return said deflector tongue into said rest position.

5. The high-voltage circuit breaker as defined in claim 1, wherein:

said elongated hole extends substantially perpendicular to said drive rod.

6. The high-voltage circuit breaker as defined in claim 1, wherein:

said elongated hole extends substantially rectilinearly.

7. The high-voltage circuit breaker as defined in claim 1, wherein:

said cam track is formed in a plate;

said plate comprises a lateral substantially rectilinear edge extending substantially parallel to said drive rod;

rollers provided for said drive rod; and said drive rod being directly guided along said lateral edge of the plate by said rollers.

8. The high-voltage circuit breaker as defined in claim 1, wherein:

said cam track is formed in a plate;

said plate comprises a lateral substantially rectilinear edge extending substantially parallel to said drive rod;

rollers provided for said drive rod; and said drive rod being indirectly guided along said lateral edge of the plate by said rollers.

9. The high-voltage circuit breaker as defined in claim 2, wherein:

said cam track is formed in a plate;

pivot pins rotatably mounted at said plate;

said deflector tongues being mounted on said pivot pins; and protruding levers interconnected by a tension spring mounted on said pivot pins.

10. The high-voltage circuit breaker as defined in claim 1, wherein:

said closed loop comprises:

a substantially convex section which is convex with respect to said drive rod and a substantially concave section which is concave with respect to said drive rod;

common end sections with which merge said convex and concave sections;

a respective deflector tongue cooperating with each said common end section; and means cooperating with said drive rod for switching said deflector tongues from one predetermined position to another predetermined position at the end of a switching stroke.

11. The high-voltage circuit breaker as defined in claim 10, wherein:

said cam track is formed in a plate;

said plate comprises a substantially rectilinear lateral edge extending substantially parallel to said drive rod;

a slide displaceable between two end positions guided at said lateral edge;

rollers for guiding said drive rod;

said slide defining a guide track for said rollers guiding said drive rod;

stops for limiting said guide track at both ends to a length which is smaller than that of said switching stroke;

said means cooperating with said drive rod for switching said deflector tongues comprise adjusting rods; and said cooperating means further including one elements provided for said slide and engaged by said adjusting rods for switching said deflector tongues.

12. The high-voltage circuit breaker as defined in claim 11, further including:

a tilting mechanism acting upon said slide for urging the same at the end of said switching stroke into a respective one of said two end positions.

* * * * *

UNITED STATES PATENT AND TRADEMARK OFFICE

CERTIFICATE OF CORRECTION

PATENT NO. : 4,513,187

DATED : April 23, 1985

INVENTOR(S) : WALTER SCHAAD et al

It is certified that error appears in the above—identified patent and that said Letters Patent is hereby corrected as shown below:

Column 9, line 34, please delete "42", first occurence, and insert —43—

Signed and Sealed this

*Twenty-fourth* Day of *September 1985*

[SEAL]

*Attest:*

*Attesting Officer*

DONALD J. QUIGG

*Commissioner of Patents and Trademarks—Designate*